United States Patent [19]

Bachler

[11] Patent Number: 4,562,418

[45] Date of Patent: Dec. 31, 1985

[54] ELECTROMAGNETICALLY OPERATED ELECTRIC SWITCH

[75] Inventor: Sven Bachler, Västerås, Sweden

[73] Assignee: ASEA Aktiebolag, Västerås, Sweden

[21] Appl. No.: 628,910

[22] Filed: Jul. 9, 1984

[30] Foreign Application Priority Data

Jul. 11, 1983 [SE] Sweden ..... 8303929

[51] Int. Cl.[4] ..... H01H 67/02

[52] U.S. Cl. ..... 335/131; 335/136

[58] Field of Search ..... 335/131, 136, 177, 181, 335/189, 192, 275, 276

[56] References Cited

U.S. PATENT DOCUMENTS

| | | | |
|---|---|---|---|
| 789,457 | 5/1905 | Sargent | 335/131 X |
| 1,561,263 | 11/1925 | Maxfield | 335/276 X |
| 4,506,242 | 3/1985 | Karpe et al. | 335/131 X |

FOREIGN PATENT DOCUMENTS

| | | | |
|---|---|---|---|
| 655812 | 1/1938 | Fed. Rep. of Germany | 335/131 |
| 45153 | 1/1966 | Fed. Rep. of Germany | 335/131 |
| 1335804 | 10/1962 | France | 335/276 |

*Primary Examiner*—George Harris

*Attorney, Agent, or Firm*—Watson, Cole, Grindle & Watson

[57] ABSTRACT

An electromagnetically operated electric switch has its movable contact system attached in a contact carrier, which via rotatable arms is connected to two identical magnetic cores of an operating magnet. Both magnetic cores move along a line perpendicular to the contact movement, towards each other upon closing and away from each other upon opening. The cores are suspended from the stand of the electric switch by means of leaf springs which control the movement of the cores. The leaf springs may also serve as opening springs.

10 Claims, 18 Drawing Figures

FIG. 5
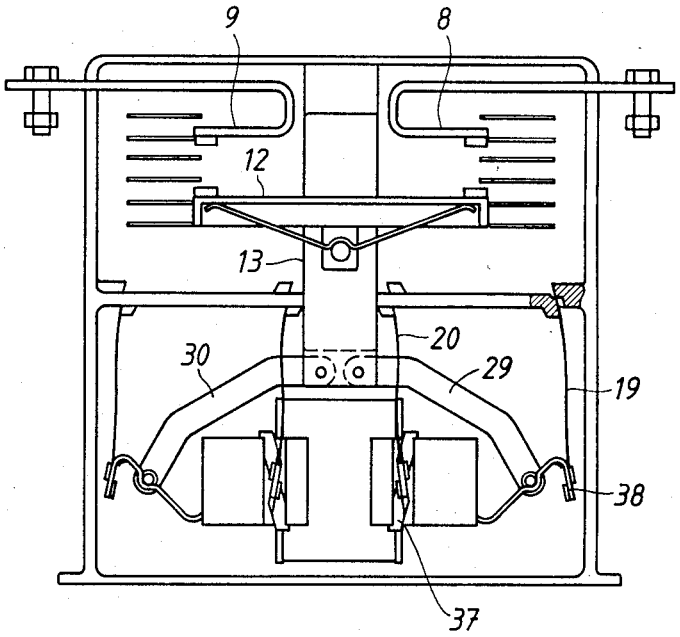
FIG. 6
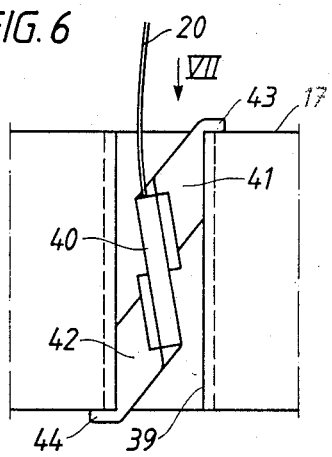
FIG. 9
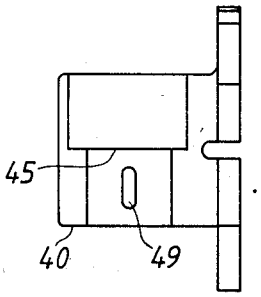
FIG. 8
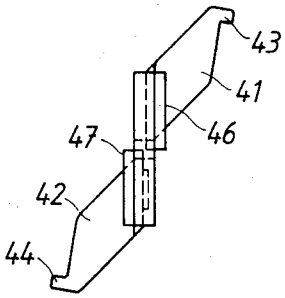
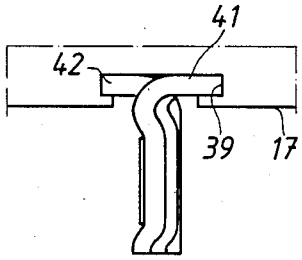
FIG. 7
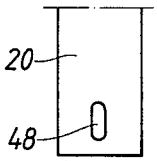
FIG. 11
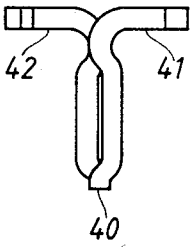
FIG. 10

ELECTROMAGNETICALLY OPERATED ELECTRIC SWITCH

BACKGROUND OF THE INVENTION

1. Field of the Invention

The present invention relates to an electromagnetically operated electric switch, for example a contactor, having at least one movable contact attached in a contact carrier, which via rotatable arms are connected to two similar magnetic cores of an operating magnet. The two cores are movable in opposite directions along a line which is substantially perpendicular to the direction of movement of the contact carrier.

2. Prior Art

A contactor of the above-mentioned kind is previously known from Swiss Pat. No. 349,324. Compared with the most frequently used contactor designs, which have a stationary magnetic core with a magnet armature which moves in the same direction as the contacts, the design described above has several advantages:

(a) Contact bounce caused by the armature movement is completely eliminated.

(b) A very considerable dynamic stability, i.e. shockproofness, is obtained both in the closed and open position and in all directions.

(c) Because of the dynamic stability in open position, the initial attractive force of the magnet can be considerably reduced and the magnet be made smaller.

(d) Through the gradual rotation of the arms, the gear ratio between the magnet movement and the contact movement is changed so that the force on the contact carrier is increased towards the end of the closing movement.

In the prior art design mentioned above, the magnetic cores are guided in slots in the contactor stand. Such a guide is subjected to considerably wear, since the cores have a relatively great weight. This means that only a small part of the mechanical life of 10-30 million of operations, stipulated for certain contactors, can be achieved. Also a construction in which the magnetic cores are suspended by means of rotatably links has a limited life, since the bearings of the links are worn out prematurely.

SUMMARY OF THE INVENTION

The object of the present invention is to provide an electromagnetically operated electric switch which exhibits the same advantages as the prior art design mentioned above and which, in addition, has a considerably greater mechanical life. This is achieved in a design according to the preamble of claim 1 by the fact that the two magnetic cores of the electric switch are suspended from the stand of the electric switch by means of leaf springs, which are arranged so as to control the movement of the cores.

According to an especially advantageous improvement of the invention, the leaf springs are also used as opening springs, thus eliminating the need of separate opening springs.

Also the attachments of the arms to the magnetic cores and to the contact carrier can be carried out by means of leaf springs, thus obtaining a bearing-free and therefore extremely durable construction.

BRIEF DESCRIPTION OF THE DRAWINGS

The invention will be described in greater detail with reference to a number of embodiments shown in the accompanying drawing, wherein

FIG. 5 shows a third embodiment of a contactor constructed according to the invention;

FIG. 6 shows on an enlarged scale part of the magnetic suspension in the embodiment according to FIG. 5;

FIG. 7 is a view in the direction VII of the attachment part according to FIG. 6;

FIGS. 8–10 show three views, positioned perpendicular to each other, of a spring attachment employed in the suspension according to FIGS. 6 and 7;

FIG. 11 shows a plane view of the end portion of a leaf spring employed in the magnetic suspension according to FIGS. 6 and 7;

DESCRIPTION OF PREFERRED EMBODIMENTS

Figure 1:
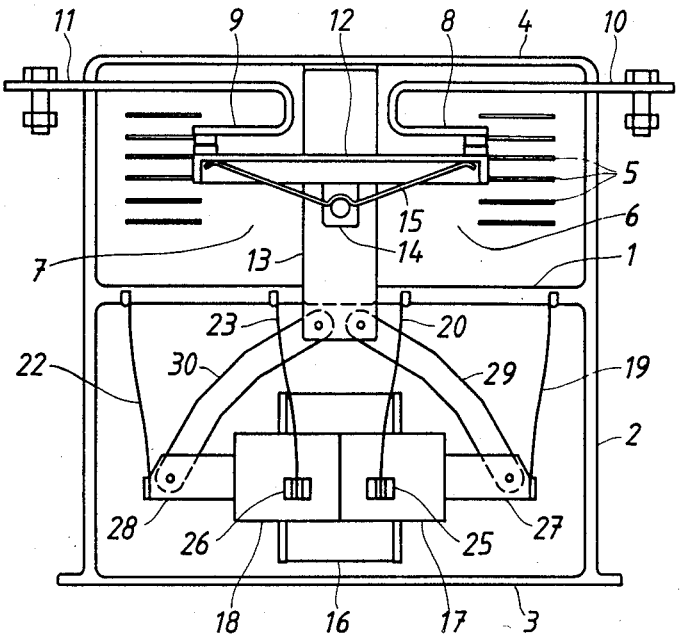
FIGS. 1 and 2 show a first embodiment of a contactor constructed according to the invention in the closed and open position, respectively.
Figure 2:
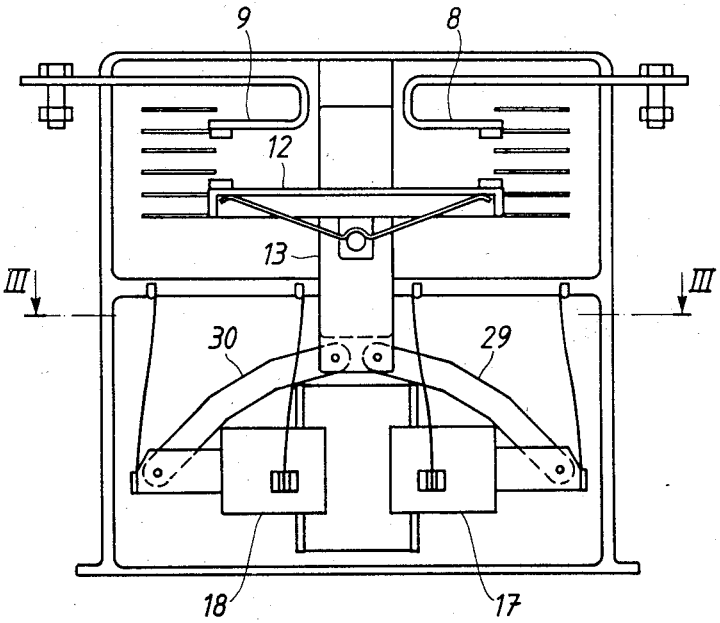
Figure 3:
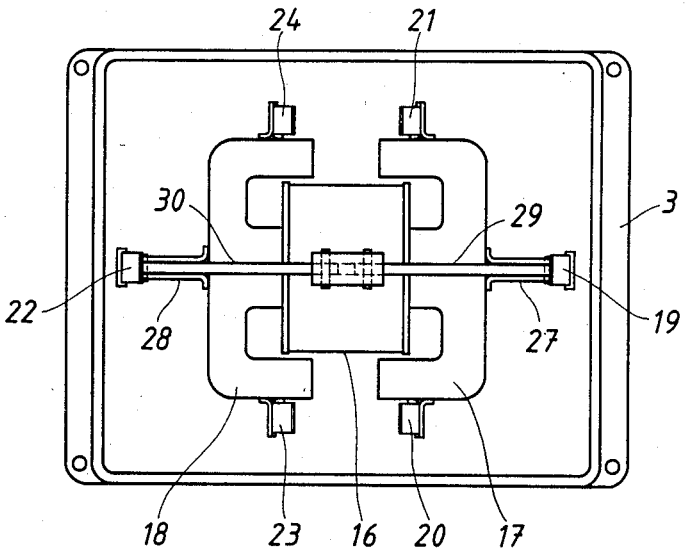
FIG. 3 shows a section through the contactor along the line III—III in FIG. 2 and shows the magnetic system of the contactor.

The contactor shown in FIGS. 1–3 may be designed for a rated voltage of, for example, 660 V and has a multi-pole contact system, of which only one pole is shown. The contactor is built up on a central stand plate 1 which has the magnetic system of the contactor on one side and the contact system of the contactor on the other side. The magnetic system is accomodated in a magnetic housing 2, the rear wall 3 of which forms a bottom plate for mounting the contactor on a base plate. The stand plate 1 and the magnet housing 2 may be made of plastic or light metal. The contact system is surrounded by an arc chute 4 of plastic provided with arc extinction plates 5.

The contact system comprises in each pole two electrically series-connected breaking units, which are each arranged in a breaking chamber 6, 7 formed in the arc chute. Each breaking unit has a fixed contact 8 and 9, respectively, which is fixed to a connection bar 10 and 11, respectively. In closed contact position the fixed contacts are connected to each other through a bridge contact 12, which is resiliently attached to a contact carrier 13 connected to the magnetic system. A contact pressure spring (not shown) is arranged in the contact carrier, said spring influencing the bridge contact 12 by means of a yoke 14 and a leaf spring 15.

The magnetic system comprises a coil 16 which is fixedly attached to the stand plate 1 and a magnetic circuit consisting of two similar E-shaped magnetic cores 17 and 18. The magnetic cores move along a line perpendicular to the contact movement, towards each other upon closing and away from each other upon opening. Each magnetic core is suspended from the stand plate by means of three elongated leaf springs 19–21 and 22–24, respectively. The leaf springs are fixed by one end to the respective magnetic core and by its other end to the stand plate 1. For the attachment of the leaf springs to the magnetic cores there are fixing brackets 25, 26 fixed to the outer legs of the E-cores as well as a protruding U-shaped yoke 27 and 28, respectively, in the middle of the yoke of each magnetic core. In the embodiment shown, the leaf springs are fixed by means of screws. However, the attachment can be performed in other ways as well, for example by means of embedment or by squeezing by means of spring clips at fixing pins arranged on the magnetic cores and on the stand, respectively.

Force and motion are transmitted from the magnetic cores 17, 18 to the contact carrier 13 by way of rotatably journalled arms 29, 30.

For the opening movement there are springs which permanently influence the magnetic cores in the opening direction. These springs may be formed in many different ways, for example as compression springs clamped directly between spring stops arranged on the magnetic cores, or as wire springs arranged at the bearings of the arms 29, 30 in the contact carrier 13. Also for this purpose it is possible to use elongated leaf springs which are directed substantially perpendicular to the direction of movement of the magnetic cores and which at their centre are attached to the yokes 27, 28 at the same location at which the leaf springs 19, 22 are fixed, and at their ends rest against supporting members fixedly arranged in the contactor housing. Especially advantageous are the embodiments described in the following, in which the opening is achieved with the aid of leaf springs 19–24, whereby the need for special opening springs is eliminated.

Figure 4:
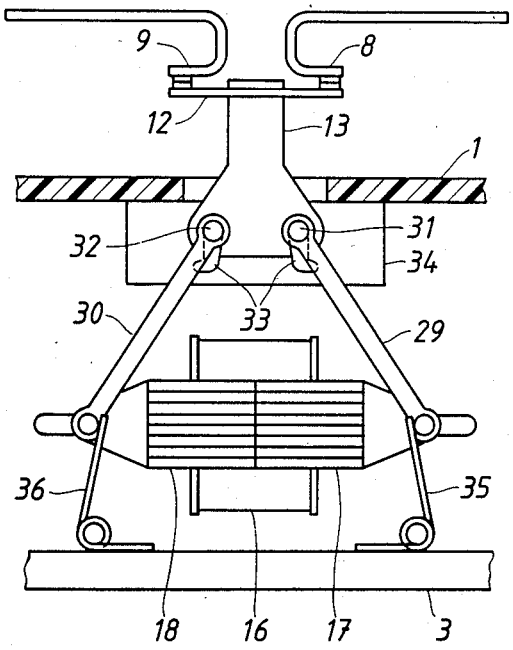
FIG. 4 shows the connection between the magnetic system and the contact system for a second embodiment of a contactor according to the invention.

FIG. 4 shows schematically an embodiment in which the bearing pins 31, 32 of the arms 29, 30 in the contact carrier 13 are guided in slots 33 in two guide plates 34 arranged on both sides of the arms, said guide plates being fixedly mounted to the stand plate 1. The guiding slots 33 are L-shaped, so that at the beginning of a closing movement the bearing pins have to move across the contact movement. By means of this embodiment an additional improvement of the shock-stability is obtained when the contactor is in the open position. FIG. 4 also shows the opening springs 35, 36, which in this case consist of wire springs which are fixed to the bottom plate 3.

FIG. 5 shows an improved design of a contact according to the invention, in which the leaf springs 19–24 for suspension of the magnetic cores 17, 18 also serve as opening springs. In this embodiment the leaf springs are considerably heavier than in the embodiment according to FIG. 1 and are obliquely clamped so as to provide a permanent force effect in the opening direction. The springs are fixed to the magnetic cores with the aid of spring attachments 37, 38, in which the springs are fixed by means of their own spring force.

FIGS. 6 and 7 show how the leaf spring 20 is attached in a dovetail slot 39 in the magnetic core 17 by means of a spring attachment 37. The spring attachment 37, which is shown separately in FIGS. 8–10, is made of sheet metal by punching and bending. The attachemnt is provided with a central portion 40 protruding from the magnetic core and with two feet 41, 42 located in a plane perpendicular to the central portion and directed in opposite directions, said feet being disposed in the dovetail slot. The feet are formed with hook-shaped end portions 43, 44 which engage the side surfaces of the magnetic core and fix the attachment in the longitudinal direction of the slot. The central portion 40 is provided with two embossment 46, 47, positioned on either side of a slit 45, directed in opposite directions and adapted to the spring 20. The end portion of the spring, as will be clear from FIG. 11, is provided with a hole 48 which is adapted to a pin 49 embossed on the embossment 47 of the spring attachment. The spring is fixed to the attachment 37 by inserting the end portion of the spring through the slit 45 between the embossments 46 and 47, and is positioned so that the pin 49 on the attachment is inserted into the hole 48 in the spring. After mounting in the contactor (FIG. 6), the spring attachment will be permanently influenced by a torsional moment, originating from the spring, directed in the clockwise direction, said moment fixing the attachment in the dovetail slot and retaining the spring in its position on the attachment.

Figure 12:
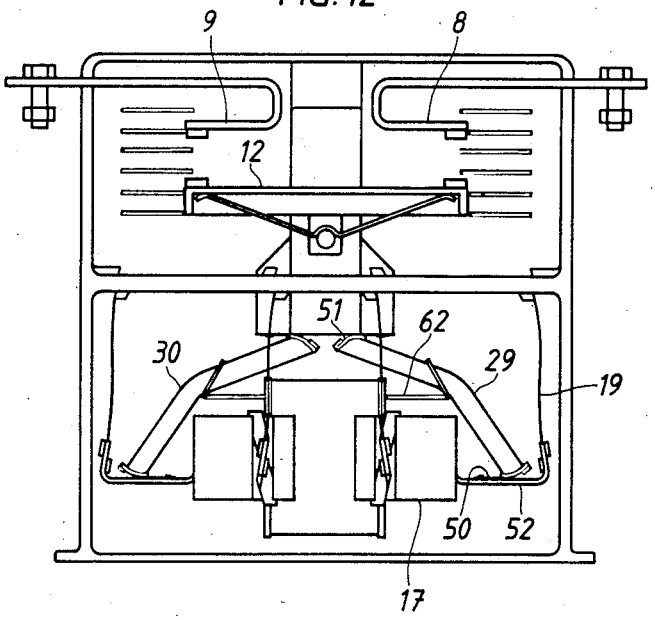
FIG. 12 shows a third embodiment of a contactor constructed according to the invention.
Figure 17:
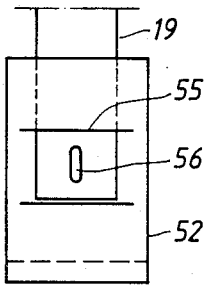
FIG. 17 shows a view in the direction marked by the arrows XVII in FIG. 13.
Figure 13:
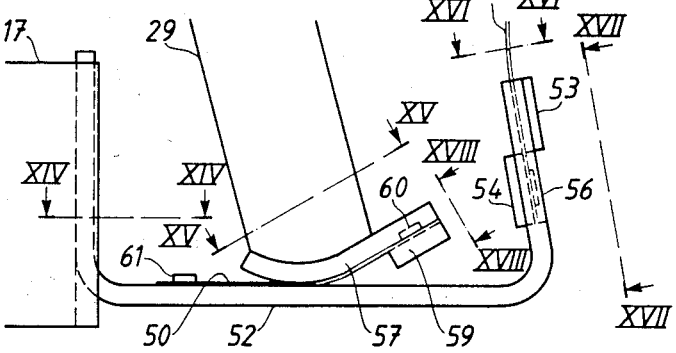
FIG. 13 shows on an enlarged scale parts of the magnetic suspension and of the coupling between the magnetic system in the contactor according to FIG. 12.
Figure 18:
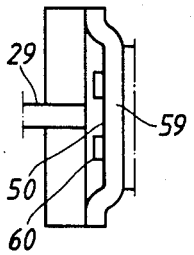
FIG. 18 shows a view in the direction marked by the arrows XVIII in FIGS. 13 and 15.
Figure 14:
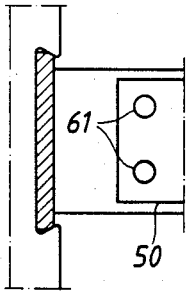
FIG. 14 shows a section along the line XIV—XIV in FIG. 13.
Figure 15:
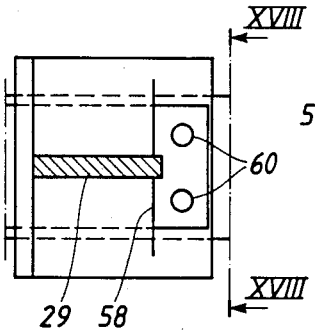
FIG. 15 shows a section along the line XV—XV in FIG. 13.
Figure 16:
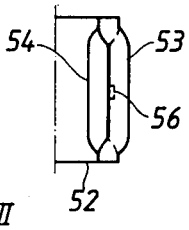
FIG. 16 shows a section along the line XVI—XVI in FIG. 13.

In the embodiments described above, the magnetic cores 17, 18 are connected to the contact carrier 13 with the aid of rotatably journalled arms. The bearings from these arms are subjected to wear, which limits the mechanical life of the contactor. FIG. 12 shows an embodiment with arms attached in a bearing-free manner between the magnetic cores and the contact carrier. The attachment of the arms is here performed with the aid of leaf springs 50 and 51. By utilizing the elasticity of the spring material also for this purpose, a force-transmitting magnetic system completely free of bearings which may be worn out is obtained.

FIGS. 13–18 show how the arm 29 and the suspension and opening spring 19 are attached to the magnetic core 17 with the aid of a substantially U-shaped attachment 52 of sheet metal. One branch of the attachment is attached to a dovetail slot in the yoke of the magnetic core 17. The other branch is provided with two embossments 53 and 54 directed in opposite directions and arranged on one side each of a transverse slit 55. The embossment 54 lying nearest the bottom part of the attachment has an outwardly-directed pin 56, which enters a hole in the end portion of the spring 19, the spring thus being fixed to the attachment by its own force (cf. FIGS. 13, 16 and 17).

The arm 29 is provided with a foot 57, which is attached to the arm, for example by welding. The foot is rotatably fixed to the bottom portion of the attachment 52 by means of the leaf spring 50. For this purpose, the foot has a slit 58 for the spring and a pressed-down end portion 59, positioned outside the slit, with two embossed upwardly-directed pins 60 which fit into holes in one end portion of the spring 50. Also the other end portion of the spring is provided with holes, into which embossed fixing pins 61 on the bottom part of the attachment 52 extend (cf. FIGS. 13, 14, 15 and 18). The attachment of the arm 29 to the contact carrier 13 is performed in a similar way by means of the leaf spring 51.

The fixing springs 50, 51 for the arm 29 and the corresponding springs for the arm 30 should, for reliable operation, be held stretched with a certain small directional force. This is achieved, in the embodiment according to FIG. 12, by means of a torsion spring 62 arranged between the arms 29 and 30, said torsion spring influencing the arms 29 and 30 by a counter-clockwise and an clock-wise torsional moment, respectively.

I claim:

1. An electromagnetically operated electric switch comprising:

a stand, a first fixed contact, a second fixed contact being disposed at a distance from said first contact, a movable contact for connecting said first and second fixed contacts, a movable contact carrier for supporting said movable contact, electromagnetic means controlling engagement of said movable contact with said fixed contacts, said electromagnetic means comprising an operating magnet with two substantially equal magnetic cores, said cores being movable in opposite directions along a line which is substantially perpendicular to the direction of movement of the contact carrier, rotatable arms for connecting said contact carrier to said magnetic cores, and leaf springs for suspending said magnetic cores from said stand, said spring being arranged so as to control the movement of said cores.

2. Electric switch according to claim 1, in which said leaf springs (19–24) are tape-formed and extend across the direction of movement of the magnetic cores (17, 18) and have one of their ends fixedly attached to the stand (1) of the electric switch and their other end fixedly attached to the respective magnetic core (17, 18).

3. Electric switch according to claim 1, in which said leaf springs (19–24) are arranged to permanently influence the magnetic cores (17, 18) by a restoring force acting against the attractive force of the operating magnet.

4. Electric switch according to claim 1, in which each magnetic core (17, 18) is suspended by means of leaf springs at three points.

5. Electric switch according to claim 1, in which said leaf springs (19–24) are attached to their respective magnetic core (17, 18) by means of spring attachments (37, 38, 52) which are fixed in dovetail slots (39) in the magnetic core.

6. Electric switch according to claim 5, in which said leaf springs (19–24) and the spring attachments (37, 38, 52) are so arranged that the end portion of the springs, after insertion into the attachments, are retained thereto through the force of the respective spring.

7. Electric switch according to claim 6, in which at least one of said spring attachments (37, 38, 52) is of sheet metal and has a slit (45, 55) and a recess (47, 54) arranged on one side of the slit, in which recess a fixing pin (49, 56) is embossed which passes into a hole (48) in the end portion of the spring inserted through the slit.

8. Electric switch according to claim 1, in which said arms (29, 30) are journalled in the contact carrier (13) with the aid of bearing pins (31, 32), which are guided in guiding slots (33) which are so formed that the bearing pins (31, 32), at the beginning of a closing movement, are given a component of a movement across the contact movement.

9. Electric switch according to claim 1, in which said rotatable arms (29, 30) are connected to the cores (17, 18) and the contact carrier (13), respectively, via leaf springs (50, 51).

10. Electric switch according to claim 9, in which a torsion spring (62) is arranged to influence the arms (29, 30), attached by means of springs (50, 51), by a torque for permanent tensioning of the attaching springs (50, 51).

* * * * *